US010174944B2

(12) United States Patent
Mays

(10) Patent No.: US 10,174,944 B2
(45) Date of Patent: Jan. 8, 2019

(54) COMBUSTOR ASSEMBLY AND METHOD THEREFOR

(75) Inventor: Jeffrey A. Mays, Canoga Park, CA (US)

(73) Assignee: Gas Technology Institute, Des Plaines, IL (US)

( * ) Notice: Subject to any disclaimer, the term of this patent is extended or adjusted under 35 U.S.C. 154(b) by 1216 days.

(21) Appl. No.: 13/407,273

(22) Filed: Feb. 28, 2012

(65) Prior Publication Data

US 2013/0220189 A1 Aug. 29, 2013

(51) Int. Cl.

| | |
|---|---|
| ***F23C 6/04*** | (2006.01) |
| ***F23L 7/00*** | (2006.01) |
| ***F23L 9/00*** | (2006.01) |

(52) U.S. Cl.

CPC ..... *F23L 7/002* (2013.01); *F23C 6/045* (2013.01); *F23L 9/00* (2013.01); *F23C 2201/102* (2013.01)

(58) Field of Classification Search

USPC ..... 431/4, 8, 10, 278; 123/584

See application file for complete search history.

(56) References Cited

U.S. PATENT DOCUMENTS 3,617,470 A * 11/1971 Schlinger et al. ..... 208/408
3,617,471 A * 11/1971 Schlinger et al. ..... 208/414
4,380,960 A * 4/1983 Dickinson ..... F01K 3/188 110/238
4,447,203 A * 5/1984 Hampton ..... C10L 1/1233 431/3
4,492,558 A * 1/1985 Schwartz ..... F23L 7/005 431/202
4,687,491 A 8/1987 Latty
4,714,032 A * 12/1987 Dickinson ..... C02F 11/086 110/238
4,930,454 A 6/1990 Latty et al.
5,013,236 A * 5/1991 Khinkis ..... F23C 3/006 431/10
5,158,445 A * 10/1992 Khinkis ..... F23C 3/006 431/10
5,404,952 A 4/1995 Vinegar et al.
6,201,029 B1 * 3/2001 Waycuilis ..... 518/703
7,517,372 B2 * 4/2009 Sennoun et al. ..... 48/127.9
7,799,946 B2 * 9/2010 Galloway ..... C07C 51/42 562/545
8,246,343 B2 * 8/2012 Ghani ..... F23C 3/008 431/10
8,387,692 B2 * 3/2013 Tilmont et al. ..... 166/272.3
8,475,160 B2 * 7/2013 Campbell et al. ..... 431/2
2011/0214858 A1 9/2011 Castrogiavanni et al.

FOREIGN PATENT DOCUMENTS

WO 2008143745 11/2008

* cited by examiner

*Primary Examiner* — Steven B McAllister
*Assistant Examiner* — Desmond C Peyton
(74) *Attorney, Agent, or Firm* — Pauley Erickson & Kottis

(57) ABSTRACT

A method for staged combustion in a combustor assembly includes introducing an oxidant stream and a fuel stream at a first location into a combustion chamber to produce a heated stream. A Liquid water stream and an additional oxidant stream, fuel stream or both are then introduced into the heated stream in at least one location along the heated stream downstream from the first location. The additional oxidant stream, fuel stream or both react in the heated stream to generate additional heat that vaporizes liquid water from the liquid water stream to water vapor.

16 Claims, 2 Drawing Sheets

COMBUSTOR ASSEMBLY AND METHOD THEREFOR

BACKGROUND

This disclosure relates to combustors and, more particularly, to staged combustors.

As energy consumption rises, alternative techniques of hydrocarbon extraction have been developed to meet demand. One example technique involves thermal stimulation of a hydrocarbon reservoir using high pressure steam to drive the hydrocarbon out. Typically, the steam is produced using a boiler or burner assembly.

SUMMARY

A combustor assembly method according to an exemplary aspect of the present disclosure comprises introducing an oxidant stream and a fuel stream at a first location into a combustion chamber to produce a heated stream and introducing a liquid water stream and introducing additional oxidant stream, fuel stream or both into the heated stream in at least one location along the heated stream downstream from the first location. The additional oxidant stream, fuel stream or both react in the heated stream to generate additional heat that vaporizes liquid water of the liquid water stream to water vapor.

In a further non-limiting embodiment of any of the foregoing assembly embodiments, the liquid water stream includes dissolved chemical constituents, and the vaporizing of the liquid water precipitates the dissolved chemical constituents into solid particulate within the heated stream.

In a further non-limiting embodiment of any of the foregoing assembly embodiments, the liquid water stream includes, downstream from the combustion chamber, removing the solid particulate from the heated stream such that the water vapor is purer than the liquid water stream introduced into the combustion chamber.

A further non-limiting embodiment of any of the foregoing assembly embodiments includes controlling an amount of liquid water introduced in the liquid water stream into the combustion chamber to limit $NO_x$ formation by maintaining a temperature within the combustion chamber below 1100° C.

A further non-limiting embodiment of any of the foregoing assembly embodiments includes controlling an amount of liquid water introduced in the liquid water stream into the combustion chamber to establish a maximum temperature T1 of the heated stream within the combustion chamber and a discharge temperature T2 of the heated stream such that a ratio of T1/T2 is no greater than 1.7.

A further non-limiting embodiment of any of the foregoing assembly embodiments includes controlling an amount of liquid water introduced in the liquid water stream into the combustion chamber to establish a maximum temperature T1 of the heated stream within the combustion chamber and a discharge temperature T2 of the heated stream such that a ratio of T1/T2 is no greater than 1.4.

A further non-limiting embodiment of any of the foregoing assembly embodiments includes controlling an amount of liquid water introduced in the liquid water stream into the combustion chamber to establish a maximum temperature T1 of the heated stream within the combustion chamber and a discharge temperature T2 of the heated stream such that a ratio of T1/T2 is from 1.3 to 1.7.

A further non-limiting embodiment of any of the foregoing assembly embodiments includes introducing the water vapor into a boiler located downstream from the combustion chamber to partially vaporize a second, different liquid water stream.

A further non-limiting embodiment of any of the foregoing assembly embodiments includes introducing a remaining portion of the second liquid water stream that is not vaporized in the boiler into the combustion chamber in the liquid water stream.

A further non-limiting embodiment of any of the foregoing assembly embodiments includes introducing the vaporized water from the second liquid water stream into a subterranean geological formation.

In a further non-limiting embodiment of any of the foregoing assembly embodiments, the oxidant stream is air and the fuel stream is methane.

A method for staged combustor assembly according to an exemplary aspect of the present disclosure comprises introducing an air stream and a methane stream at a first location into a combustion chamber to produce a heated stream, introducing a liquid water stream and an additional air stream, methane stream or both into the heated stream in at least one location along the heated stream downstream from the first location. The additional air stream, methane stream or both react in the heated stream to generate additional heat that vaporizes liquid water from the liquid water stream to water vapor. An amount of the liquid water introduced into the combustion chamber is controlled to establish a maximum temperature T1 of the heated stream within the combustion chamber and a discharge temperature T2 of the heated stream from the combustion chamber such that a ratio of T1/T2 is no greater than 1.7. The water vapor is introduced into a boiler located downstream from the combustion chamber to partially vaporize a second, different liquid water stream.

A further non-limiting embodiment of any of the foregoing method embodiments includes controlling an amount of the liquid water introduced into the combustion chamber in the liquid water stream to establish a maximum temperature T1 of the heated stream within the combustion chamber and a discharge temperature T2 of the heated stream such that a ratio of T1/T2 is from 1.3 to 1.7.

A further non-limiting embodiment of any of the foregoing method embodiments includes introducing a remaining portion of the second liquid water stream that is not vaporized in the boiler into the combustion chamber as the liquid water.

A further non-limiting embodiment of any of the foregoing method embodiments includes introducing the vaporized water from the second liquid water stream into a subterranean geological formation.

A combustor assembly according to an exemplary aspect of the present disclosure comprises a combustion chamber having, in serial flow arrangement, at least a first section and a second section, the first section including a first oxidant feed and a first fuel feed, and the second section including a second feed of oxidant, fuel or both and a first liquid water feed.

A further non-limiting embodiment of any of the foregoing assembly embodiments includes a third section including a third feed of oxidant, fuel or both and a second liquid water feed.

In a further non-limiting embodiment of any of the foregoing assembly embodiments, includes the second feed and the first liquid water feed are at equivalent axial locations with regard to a central longitudinal axis of the combustion chamber, and the third feed and the second liquid water feed are at equivalent axial locations with regard to the central longitudinal axis of the combustion chamber.

In a further non-limiting embodiment of any of the foregoing assembly embodiments, the first section includes an additional liquid water feed.

In a further non-limiting embodiment of any of the foregoing assembly embodiments, a boiler is connected in flow-receiving communication with the combustion chamber.

In a further non-limiting embodiment of any of the foregoing assembly embodiments, a feedback passage is connected with an output of the boiler and at least one of the first liquid water feed and the second liquid water feed.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION OF THE PREFERRED EMBODIMENT

Figure 1:
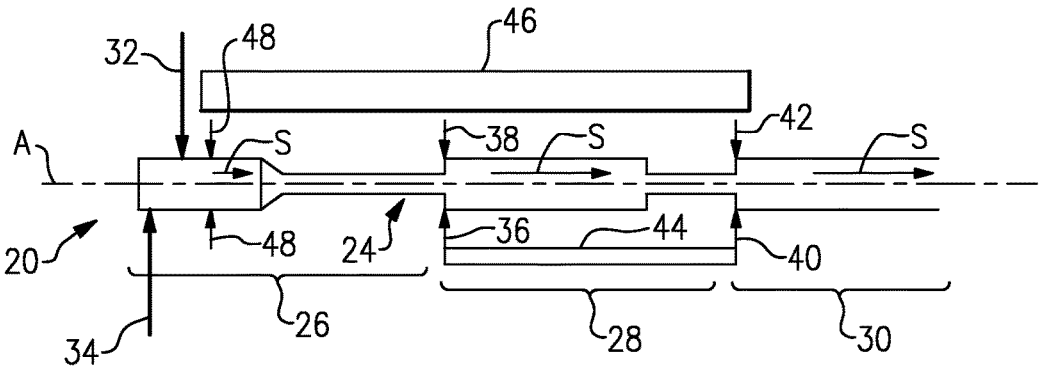
FIG. 1 illustrates an example combustor assembly.
Figure 2:
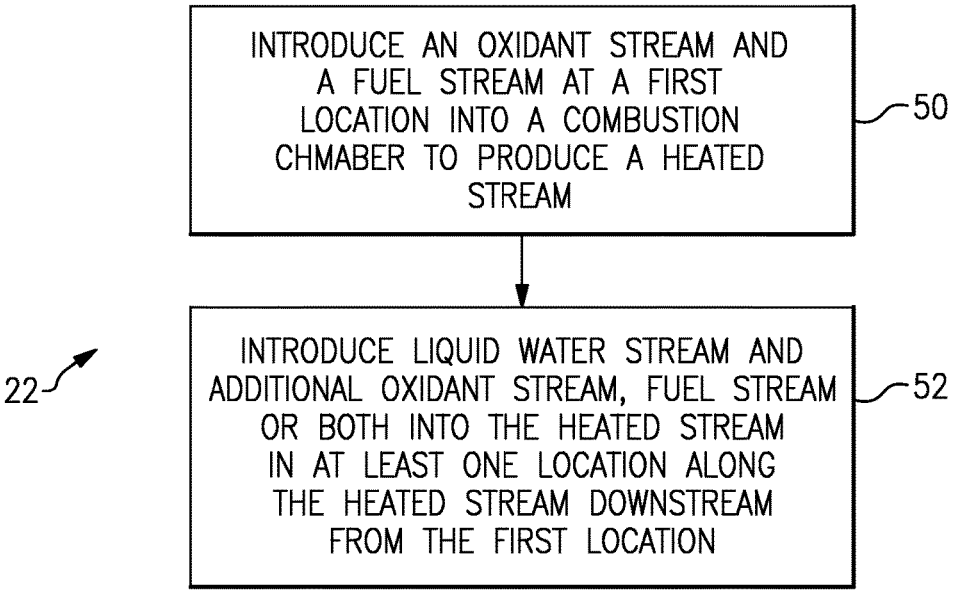
FIG. 2 illustrates an example method for staged combustion in a combustor assembly.

FIG. 1 illustrates an example combustor assembly 20, and FIG. 2 illustrates an example method 22 for staged combustion in the combustor assembly 20, which embodies the combustor assembly 20. As will be described, the combustor assembly 20 and the method 22 reduce the formation of nitrogen oxides ($NO_x$) in the combustion of hydrocarbon material.

Referring to FIG. 1, the combustor assembly 20 includes a combustion chamber 24 having, in serial flow arrangement, a first section 26, a second section 28 and an optional, third section 30. The first section 26 includes a first oxidant feed 32 and a first fuel feed 34. The second section 28 includes a second feed 36 of oxidant, fuel or both and a first liquid water feed 38. The third section 30 includes a third feed 40 of oxidant, fuel or both and a second liquid water feed 42. It is to be understood that one or more additional sections with additional oxidant, fuel and liquid feeds may be used, although additional sections may increase the temperature within the combustion chamber and threaten $NO_x$ formation.

In this example, the second feed 36 and the first liquid water feed 38 are at axial location $L_1$ with regard to a central longitudinal axis A of the combustion chamber 24, and the third feed 40 and the second liquid water feed 42 are at axial location $L_2$ with regard to the central longitudinal axis A of the combustion chamber 24.

The sections 26, 28 and 30 of the combustion chamber 24 are arranged in serial flow communication axially along the central longitudinal axis A, although the sections 26, 28 and 30 may alternatively be configured in an arcuate or non-axial arrangement. Optionally, the feeds 36 and 40 are fed from one or more common manifolds or plenums 44 that are provided with, respectively, oxidant or fuel. Likewise, the liquid water feeds 38 and 42 may be fed from a common liquid water manifold or plenum 46.

In this example, the second feed 36 and the first liquid water feed 38 of the second section 28 are located downstream from the first section 26. The first section, for purposes of this disclosure, represents a first location. The third feed 40 and the second liquid water feed 42 of the third section 30 are located downstream from the second section 28, and thus are downstream from the second feed 36 and the first liquid water feed 38 of the second section 28. The combustor assembly 20 is thus arranged for staged combustion within the combustion chamber 24 with regard to the serial location of the feeds 34, 36 and 40.

The operation of the combustor assembly 20 will now be described with reference to the method 22 illustrated in FIG. 2. The method 22 generally includes an initial introduction step 50 and a staged introduction step 52. The initial introduction step 50 includes introducing an oxidant stream, such as air, and a fuel stream, such as methane or other hydrocarbon, at the first location (the first section 26) into the combustion chamber 24 to produce a heated stream, which is indicated at S. The air may be compressed or otherwise treated prior to introduction. The staged introduction step 52 includes introducing a liquid water stream and an additional, different oxidant stream, fuel stream or both into the heated stream S in at least one location along the heated stream S downstream from the first location. The additional oxidant stream, fuel stream or both react in the heated stream S to generate additional heat that vaporizes the liquid water to produce water vapor.

In the initial introduction step 50, the oxidant stream is introduced through the first oxidant feed 32 and the fuel stream is introduced through the first fuel feed 34. In the staged introduction step 52, additional oxidant streams, fuel streams or both is introduced through the second feed 36 and the third feed 40. Liquid water is introduced through the first liquid water feed 38 and the second liquid water feed 42. Optionally, liquid water is also introduced into the first section 26 through an additional liquid water feed 48.

The fuel and oxidant react in the first section 26 to generate the heated stream S of combustion products. For example, although the fuel and the oxidant react, the initial combustion produces intermediate combustion products. The downstream introduction of the additional oxidant stream, fuel stream or both thus drives further reaction of the intermediate combustion products to produce additional heat. The additional heat is used to vaporize the liquid water introduced into the combustion chamber 24.

The introduction of the liquid water streams serves to control a maximum temperature T1 within the combustion chamber 24 and a discharge temperature T2 of the heated stream S as it leaves the combustion chamber 24. Thus, by controlling the amount of liquid water introduced into the combustion chamber 24, such as by adjusting flow, the temperatures T1 and T2 can be controlled for given amounts of fuel and oxidant used and given process parameters, such as pressure. In one example, at a pressure approximately 400 psi/2.8 megapascals, the maximum temperature T1 is controlled to be below 1100° C./2012° F. to limit $NO_x$ formation that occurs above 1100° C./2012° F. As will be described in further detail below, the amount of liquid water introduced into the combustion chamber 24 can also be controlled to establish a desired ratio of T1/T2.

Figure 3:
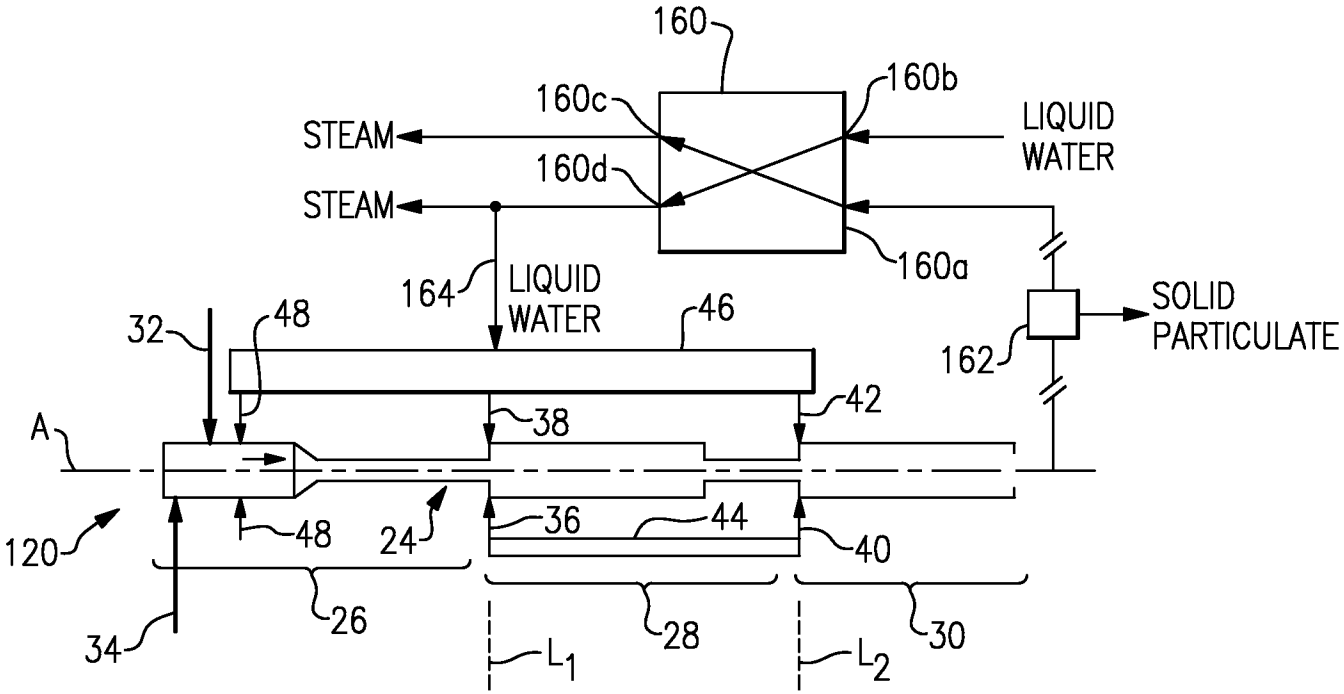
FIG. 3 illustrates another example combustor assembly for steam generation.

FIG. 3 illustrates a further example in which a combustor assembly 120 is used in generating steam, such as for the extraction of hydrocarbon materials from a subterranean region. It is to be understood, however, that the combustor assembly 120 and the method 22 may alternatively be used for other purposes. As will be described, the combustor assembly 120 and the method 22 are used in steam generation to purify process water that includes minerals or other dissolved impurities that can cause scaling and fouling.

In this example, the combustor assembly 120 is similar to the combustor assembly 20 of FIG. 1 but additionally includes a boiler 160 that is connected in flow-receiving communication with the combustion chamber 24. The boiler 160 thus receives the heated stream S, including water vapor carried in the heated stream S. In this example, a filter 162 is included between the combustion chamber 24 and the boiler 160 for removing solid particulate from the water vapor and heated stream S.

The boiler 160 includes a first inlet 160*a* through which the heated stream S, or at least the water vapor if separated, is received into the boiler 160 and a second inlet 160*b* through which another or second, different liquid water stream is received. As an example, the second liquid water stream includes what is referred to as "produced water." "Produced water" is often characterized as untreated water having a high mineral content, which undesirably encourages scaling and fouling in some components.

The boiler 160 further includes a first outlet 160*c* through which the heated stream S, or at least the water vapor if separated, is discharged from the boiler 160 and a second outlet 160*d* through which liquid and vaporized water from the initial liquid water stream is discharged. A feedback passage 164 is connected with the second outlet 160*d* of the boiler 160 and the liquid water plenum 46 to direct liquid water from the boiler 160 into at least one of the first liquid water feed 38 and the second liquid water feed 42.

The operation of the combustor assembly 120 will now be described with further reference to the method 22. In one example, the method 22 further includes introducing the water vapor from the heated stream S into the boiler 160 located downstream from the combustion chamber 24 to partially vaporize the second liquid water stream received through the second inlet 160*b*. The vaporized water generated from the second liquid water stream and any remaining portion of the second liquid water stream that is not vaporized in the boiler 160, which is known as blowdown water, are discharged through the second outlet 160*d*. The remaining liquid water is fed through the feedback passage 164 and into the combustion chamber 24. The vaporized water from the water stream is introduced or injected into a subterranean geological formation for hydrocarbon extraction.

As a result of the partial vaporization of the "produced water" input into the boiler 160, the blowdown water has a high concentration of minerals and other impurities relative to the input "produced water." However, instead of discarding the blowdown water as waste, which can add expense to a system and process, the blowdown water is processed through the combustion chamber 24 to purify and remove the minerals and impurities. As an example, the vaporizing of the blowdown water in the combustion chamber 24 precipitates dissolved chemical constituents, such as the minerals and impurities, into solid particulate entrained within the heated stream S. Upon discharge from the combustion chamber 24, the solid particulate is removed from the heated stream S in the filter 162 such that the resulting water vapor is purer than the liquid water introduced into the combustion chamber 24.

As indicated above, in addition to controlling the maximum temperature T1 in the combustion chamber 24 to be below 1100° C./2012° F. to limit $NO_x$ formation, the amount of liquid water introduced into the combustion chamber 24 can also be controlled to establish a desired ratio of T1/T2. For example, the amount of liquid water introduced into the combustion chamber 24 for given amounts of fuel and oxidant is controlled to establish a ratio of T1/T2 (T1 divided by T2) that is no greater than 1.7. The ratio ensures that $NO_x$ formation is limited and that the heated stream S is at a suitable elevated temperature when discharged from the combustion chamber 24 such that the minerals and impurities are precipitated as solid particulate for removal in the filter 162. In a further example, the ratio of T1/T2 is 1.4 or is from 1.3 to 1.7. The ratio of 1.3 to 1.7 further ensures that the vaporized water is at a suitable elevated temperature for efficiently vaporizing the liquid water stream in the boiler 160.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method for staged combustion in a combustor assembly, the method comprising:

introducing an oxidant stream and a fuel stream at a first location into a combustion chamber to produce a heated stream; and introducing a liquid water stream and a stream of additional oxidant, additional fuel or both additional oxidant and additional fuel into the heated stream in at least one location along the heated stream downstream from the first location, the liquid water stream including dissolved chemical constituents, the stream of additional oxidant, additional fuel or both additional oxidant and additional fuel reacting in the heated stream to generate combustion gases and additional heat to completely vaporize the liquid water of the liquid water stream to water vapor;

wherein the vaporizing of the liquid water precipitates the dissolved chemical constituents into solid particulate with the water vapor and combustion gases, and wherein downstream from the combustion chamber, a stream of the water vapor and combustion gases containing the solid particulate is passed through a filter to remove the solid particulate such that the water vapor is purer than the liquid water stream introduced into the combustion chamber, the method additionally comprising:

introducing the water vapor into a boiler located downstream from the filter to partially vaporize a second, different liquid water stream, and introducing a remaining portion of the second liquid water stream that is not vaporized in the boiler into the combustion chamber in the liquid water stream, wherein the second liquid water stream comprises produced water.

2. The method as recited in claim 1, including controlling an amount of liquid water introduced in the liquid water stream into the combustion chamber to limit $NO_x$ formation by maintaining a temperature within the combustion chamber below 1100° C.

3. The method as recited in claim 1, including controlling an amount of liquid water introduced in the liquid water stream into the combustion chamber to establish a maximum temperature T1 of the heated stream within the combustion chamber and a discharge temperature T2 of the heated stream such that a ratio of T1/T2 is no greater than 1.7.

4. The method as recited in claim 1, including controlling an amount of liquid water introduced in the liquid water stream into the combustion chamber to establish a maximum temperature T1 of the heated stream within the combustion chamber and a discharge temperature T2 of the heated stream such that a ratio of T1/T2 is no greater than 1.4.

5. The method as recited in claim 1, including controlling an amount of liquid water introduced in the liquid water stream into the combustion chamber to establish a maximum temperature T1 of the heated stream within the combustion chamber and a discharge temperature T2 of the heated stream such that a ratio of T1/T2 is from 1.3 to 1.7.

6. The method as recited in claim 1, including introducing the vaporized water from the second liquid water stream into a subterranean geological formation.

7. The method as recited in claim 1, wherein the oxidant stream is air and the fuel stream is methane.

8. A method for staged combustion in a combustor assembly, the method comprising:

introducing an air stream and a methane stream at a first location into a combustion chamber to produce a heated stream;

introducing a liquid water stream and a stream of additional air, additional methane or both additional air and additional methane into the heated stream in at least one location along the heated stream downstream from the first location, the liquid water stream including dissolved chemical constituents, the stream of additional air, additional methane or both additional air and additional methane reacting in the heated stream to generate combustion gases and additional heat to vaporize the liquid water from the liquid water stream to water vapor;

controlling an amount of the liquid water introduced into the combustion chamber to establish a maximum temperature T1 of the heated stream within the combustion chamber and a discharge temperature T2 of the heated stream from the combustion chamber such that a ratio of T1/T2 is no greater than 1.7; and introducing the water vapor into a boiler located downstream from the combustion chamber to partially vaporize a second, different liquid water stream, wherein the vaporizing of the liquid water precipitates the dissolved chemical constituents into solid particulate with the water vapor and combustion gases, and wherein downstream from the combustion chamber and upstream of the boiler, said method additionally comprising passing a stream of the water vapor and combustion gases containing the solid particulate through a filter element to remove the solid particulate such that the water vapor is purer than the liquid water stream introduced into the combustion chamber.

9. The method as recited in claim 8, including controlling an amount of the liquid water introduced into the combustion chamber in the liquid water stream to establish a maximum temperature T1 of the heated stream within the combustion chamber and a discharge temperature T2 of the heated stream such that a ratio of T1/T2 is from 1.3 to 1.7.

10. The method as recited in claim 8, including introducing a remaining portion of the second liquid water stream that is not vaporized in the boiler into the combustion chamber as the liquid water.

11. The method as recited in claim 8, including introducing the vaporized water from the second liquid water stream into a subterranean geological formation.

12. A method for staged combustion in a combustor assembly, the method comprising:

introducing an oxidant stream and a fuel stream at a first location into a combustion chamber to produce a heated stream;

introducing a liquid water stream and a stream of additional oxidant, additional fuel or both additional oxidant and additional fuel into the heated stream in at least one location along the heated stream downstream from the first location, the liquid water stream including dissolved chemical constituents, the additional oxidant, additional fuel or both additional oxidant and additional fuel reacting in the heated stream to generate combustion gases and additional heat to vaporize the liquid water of the liquid water stream to water vapor;

controlling an amount of liquid water introduced in the liquid water stream into the combustion chamber to establish a maximum temperature T1 of the heated stream within the combustion chamber and a discharge temperature T2 of the heated stream such that a ratio of T1/T2 is no greater than 1.7 and maintaining a temperature within the combustion chamber below 1100° C.;

introducing the water vapor into a boiler located downstream from the combustion chamber to partially vaporize a second, different liquid water stream; and introducing a remaining portion of the second liquid water stream that is not vaporized in the boiler into the combustion chamber as the liquid water, wherein the vaporizing of the liquid water precipitates the dissolved chemical constituents into solid particulate with the water vapor and combustion gases, and wherein the method additionally comprises downstream from the combustion chamber and upstream of the boiler passing a stream of the water vapor and combustion gases containing the solid particulate through a filter to remove the solid particulate such that the water vapor is purer than the liquid water stream introduced into the combustion chamber.

13. The method as recited in claim 12, wherein the oxidant stream is air and the fuel stream is methane.

14. The method as recited in claim 12, including introducing the vaporized water from the second liquid water stream into a subterranean geological formation for hydrocarbon extraction.

15. The method as recited in claim 8, wherein the second liquid water stream comprises produced water.

16. The method as recited in claim 12, wherein the second liquid water stream comprises produced water.

* * * * *